US010690303B2

(12) United States Patent
Gupta

(10) Patent No.: US 10,690,303 B2
(45) Date of Patent: Jun. 23, 2020

(54) LIGHTING DEVICES AND METHODS

(71) Applicant: BEZEL STUDIO, San Anselmo, CA (US)

(72) Inventor: Jess Gupta, San Anselmo, CA (US)

(73) Assignee: BEZEL STUDIO, San Anselmo, CA (US)

( * ) Notice: Subject to any disclaimer, the term of this patent is extended or adjusted under 35 U.S.C. 154(b) by 0 days.

(21) Appl. No.: 16/232,157

(22) Filed: Dec. 26, 2018

(65) Prior Publication Data

US 2019/0203892 A1 Jul. 4, 2019

Related U.S. Application Data

(60) Provisional application No. 62/611,208, filed on Dec. 28, 2017.

(51) Int. Cl.

| | |
|---|---|
| ***F21S 6/00*** | (2006.01) |
| ***F21V 5/04*** | (2006.01) |
| ***F21V 5/00*** | (2018.01) |
| ***F21V 13/06*** | (2006.01) |
| ***F21V 23/04*** | (2006.01) |
| ***F21V 21/22*** | (2006.01) |
| ***F21V 14/04*** | (2006.01) |
| ***F21V 7/00*** | (2006.01) |
| ***F21V 14/06*** | (2006.01) |
| ***F21Y 115/10*** | (2016.01) |

(52) U.S. Cl.

CPC ..... *F21S 6/003* (2013.01); *F21S 6/006* (2013.01); *F21V 5/008* (2013.01); *F21V 5/04* (2013.01); *F21V 7/0008* (2013.01); *F21V 13/06* (2013.01); *F21V 14/04* (2013.01); *F21V 14/06* (2013.01); *F21V 21/22* (2013.01); *F21V 23/04* (2013.01); *F21Y 2115/10* (2016.08)

(58) Field of Classification Search

CPC ..... F21S 6/003; F21S 6/006; F21V 14/06; F21V 7/0008; F21V 14/04; F21V 21/22; F21V 23/04; F21V 13/06; F21V 5/008; F21V 5/04; F21V 13/02; F21Y 2115/10

See application file for complete search history.

(56) References Cited

U.S. PATENT DOCUMENTS

| | | | | |
|---|---|---|---|---|
| 4,098,549 | A | 7/1978 | Matsumura | |
| 5,575,550 | A * | 11/1996 | Appeldorn | F21S 8/085 362/559 |
| 7,261,438 | B2 | 8/2007 | Alessio | |
| 7,798,667 | B2 | 9/2010 | Klipstein | |
| 7,810,967 | B2 | 10/2010 | Ko et al. | |
| 7,823,783 | B2 | 11/2010 | Gerst et al. | |

(Continued)

FOREIGN PATENT DOCUMENTS

| | | | |
|---|---|---|---|
| CN | 10166067 | A | 3/2010 |
| DE | 2831926 | A1 | 2/1980 |

(Continued)

*Primary Examiner* — Joseph L Williams
*Assistant Examiner* — Jose M Diaz
(74) *Attorney, Agent, or Firm* — Buchalter; Cecily Anne O'Regan

(57) ABSTRACT

Disclosed are lighting devices and methods which allow a user to focus light in an otherwise dark environment on a target area. The lighting devices can have a nestable-collapsible configuration and a rotatable reflector which allows light to be focused on a target location during use.

23 Claims, 5 Drawing Sheets

(56) References Cited

U.S. PATENT DOCUMENTS

| | | | | |
|---|---|---|---|---|
| 7,871,192 | B2 | 1/2011 | Chien | |
| 8,083,376 | B2 | 12/2011 | Chien | |
| 9,170,006 | B2 | 10/2015 | Cugini et al. | |
| 2005/0087601 | A1 | 4/2005 | Gerst et al. | |
| 2008/0111976 | A1* | 5/2008 | Takito | G03B 21/10 353/121 |
| 2008/0198615 | A1 | 8/2008 | Klipstein | |
| 2009/0122563 | A1 | 5/2009 | Ko et al. | |
| 2009/0135380 | A1 | 5/2009 | Chien | |
| 2010/0213849 | A1 | 8/2010 | Chien | |
| 2011/0063835 | A1 | 3/2011 | Rivas et al. | |
| 2012/0298049 | A1 | 11/2012 | Cook et al. | |
| 2012/0300438 | A1 | 11/2012 | Tarter et al. | |
| 2013/0063947 | A1* | 3/2013 | Knappschneider | F21S 2/00 362/277 |
| 2013/0128565 | A1 | 5/2013 | Cugini et al. | |
| 2014/0043665 | A1* | 2/2014 | Deguenther | G03F 7/70058 359/225.1 |

FOREIGN PATENT DOCUMENTS

| | | | |
|---|---|---|---|
| GB | 726353 | A | 3/1955 |
| GB | 2140571 | A | 11/1984 |
| WO | 2004001287 | A1 | 12/2003 |
| WO | 2019133653 | A1 | 7/2019 |

* cited by examiner

LIGHTING DEVICES AND METHODS

CROSS-REFERENCE

This application claims the benefit of U.S. Provisional Application No. 62/611,208, filed Dec. 28, 2017, entitled RETRACTABLE TASK LIGHTING DEVICES AND METHODS, which application is incorporated herein in its entirety by reference.

BACKGROUND

The disclosure relates generally to task lights and more particularly, optical towers providing discrete task lighting having a first configuration and a second configuration.

Task lights typically provide a light source or bulb that is partially or completely exposed to the work surface. Current designs result in task lights illuminating more than the task at hand and/or providing inadequate lighting for the task to be performed. What is needed are lights that more discretely light a target area, such as a task area, with adequate light while avoiding lighting areas outside the target area.

SUMMARY

Disclosed are lights which provide discrete, yet powerful, lighting for a task or other uses where a focused light is desirable. The disclosed lights are suitable for uses where, for example, a task to be performed is in an otherwise darkened environment. For example, reading in bed, changing a baby's diaper during the night, and so on. Other uses include, for example, where focused light is desirable such as for displaying art work or sculptures.

The disclosure is directed to lighting devices. Suitable lighting devices comprise: a base; a light element positioned on an upper surface of the base wherein the light element emits light; a first hollow member having a first hollow member first end, a first hollow member second end and a cavity within the first hollow member wherein the first hollow member first end engages the upper surface of the base; a pair of biconvex lenses positioned within the cavity of the first hollow member; a reflector opposite the base wherein the reflector reflects light from the cavity of the first hollow member to a location exterior to the first hollow member; and a power source. Any suitable light source can be used including, for example, an LED light. In some configurations, the light source passes through an aperture in a base top and/or an aperture in the first hollow member. The cross-sectional shape of the lighting devices can be, for example, round, oval, ovoid, square, rectangular and triangular. The pair of biconvex lenses used in any configuration cab be positioned adjacent each other within the first hollow member. In some configurations, a third biconvex lens can also be provided. The third biconvex lens can be positioned adjacent the reflector positioned at the first hollow member second end. A cap can also be provided for housing the reflector. In some configurations, the reflector is rotatable. A second hollow member can also be provided in some configurations and a third hollow member, wherein the third hollow member is positionable about the second hollow member. A dimmer and/or timer can also be provided which changes the amount of light or the time a light is on. A base extension can also be provided which extends the overall height of the lighting device. The power source can be any suitable source including, for example, an electrical cord with an electrical plug, one or more batteries, and one or more solar cells.

Another aspect of the disclosure is directed to a method of illuminating a target. Suitable methods comprise: providing a lighting device wherein the lighting device comprises a base, a light element positioned on an upper surface of the base wherein the light element emits light, a first hollow member having a first hollow member first end, a first hollow member second end and a cavity within the first hollow member wherein the first hollow member first end engages the upper surface of the base, a pair of biconvex lenses positioned within a cavity of the first hollow member, a reflector opposite the base wherein the reflector reflects light from the cavity of the first hollow member to a location exterior to the first hollow member, and a power source; and providing a discrete light to a target location. Additionally, methods can include one or more of: changing the lighting device from a compressed configuration to an expanded configuration, adjusting an amount of expansion of the lighting device to change an amount of light focused on the target location; activating a dimmer to alter an amount of light generated by the lighting device; and/or securing the lighting device to a base extension. A timer can also be included to control the amount of time the lighting device illuminates.

Still another aspect of the disclosure is directed to lighting devices comprising: a base; a light element means positioned on an upper surface of the base wherein the light element means emits light; a first hollow member means having a first hollow member first end, a first hollow member second end and a cavity within the first hollow member means wherein the first hollow member first end engages the upper surface of the base; a pair of biconvex lenses positioned within the cavity of the first hollow member means; a reflector means opposite the base wherein the reflector reflects to light from the cavity of the first hollow member to a location exterior to the first hollow member; and a power source. The cross-sectional shape of the lighting device can be round, oval, ovoid, square, rectangular and triangular. The pair of biconvex lenses are positionable adjacent each other within the first hollow member means in some configurations. A third biconvex lens can also be provided. The third biconvex lens can be positioned adjacent the reflector means positioned at the first hollow member second end. A second hollow member means and a third hollow member means positionable about the second hollow member means.

INCORPORATION BY REFERENCE

All publications, patents, and patent applications mentioned in this specification are herein incorporated by reference to the same extent as if each individual publication, patent, or patent application was specifically and individually indicated to be incorporated by reference. See, for example, CN 101660667 A published Mar. 3, 2010 to Zhou et al. for Portable Spotlighting-Floodlighting Lamp;

GB 726353 A published Mar. 16, 1955 to Ritter Company, Inc. for Improvements in or relating to Spotlights Particularly for Dental Use;

U.S. Pat. No. 7,261,438-B2 issued Aug. 28, 2007 to Alessio for Lighting Device with Adjustable Spotlight Beam;

U.S. Pat. No. 7,798,667 B2 issued Sep. 21, 2010 to Klipstein for LED Spotlight;

U.S. Pat. No. 7,810,967 B2 issued Oct. 12, 2010 to Ko et al. for Adjustable Grill Light and Methods of Use Thereof;

U.S. Pat. No. 7,823,783 B2 issued Nov. 2, 2010, to Gerst et al. for Light Pipe illumination system and method;

U.S. Pat. No. 7,871,192 B2 issued Jan. 18, 2011 to Chien for LED Night Light has Projection or Image Feature;

U.S. Pat. No. 8,083,376 B2 issued Dec. 27, 2011 to Chien for LED Power Failure Light;

U.S. Pat. No. 9,170,006 B2 issued Oct. 27, 2015 to Cugini et al. for Light Figure Reconfigurable between Area Lighting and Spot Lighting Configurations;

US 2005/0087601 A1 published Apr. 28, 2005, to Gerst et al. for Light Pipe illumination system and method;

US 2008/0198615 A1 published Aug. 21, 2008 to Klipstein for LED Spotlight;

US 2009/0122563 A1 published May 14, 2009 to Ko et al. for Adjustable Grill Light and Methods of Use Thereof;

US 2009/0135380 A1 published May 28, 2009 to Chien for LED Night Light has Projection or Image Feature;

US 2010/0213849 A1 published Aug. 26, 2011 to Chien for LED Power Failure Light;

US 2011/0063835 A1 published Mar. 17, 2011, to Rivas et al. for LED Lighting Apparatus;

US 2012/0300438 A1 published Nov. 29, 2012 to Tarter et al. for Folding Spotlight;

US 2013/0128565 A1 published May 23, 2013 to Cugini et al. for Light Figure Reconfigurable between Area Lighting and Spot Lighting Configurations; and WO 2004/001287 A1 published Dec. 31, 2003 to Alessio for Lighting Device with Adjustable Spotlight Beam.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION

Figure 1A:
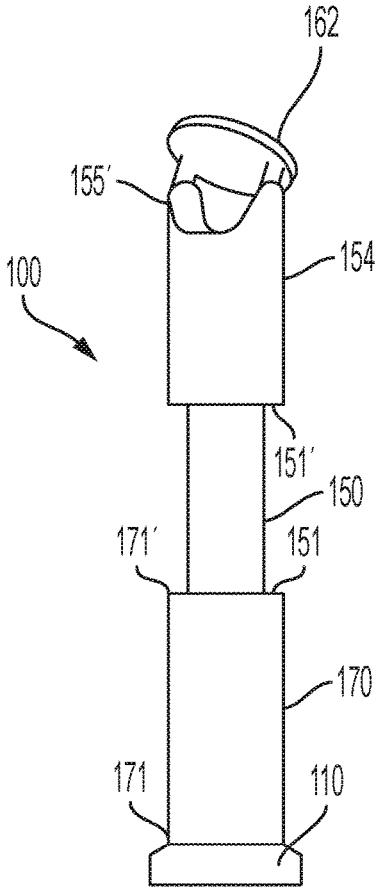
FIG. 1A is an exterior view of a suitable lighting fixture according to the disclosure.

FIG. 1A is an exterior view of a lighting fixture 100 according to the disclosure. The exterior view of the lighting fixture 100 in FIG. 1A is presented in an expanded view. The lighting fixture 100 has a base 110 and an outer hollow member 170 engaging the base 110 at a first outer hollow member end 171. A second hollow member 150, which is a second optical lens housing member, fits partially within the outer hollow member 170 at a second outer hollow member end 171' at a second hollow member first end 151, and within a third hollow member 154 at a second hollow member second end 151'. A reflective enclosure 162 engages the third hollow member 154 at a third hollow member second end 155'. The reflective enclosure 162 can be hinged where it engages the third hollow member 154. The optical lens housing member 130 is not visible in FIG. 1A because it is positioned within the outer hollow member 170.

Figure 1B:
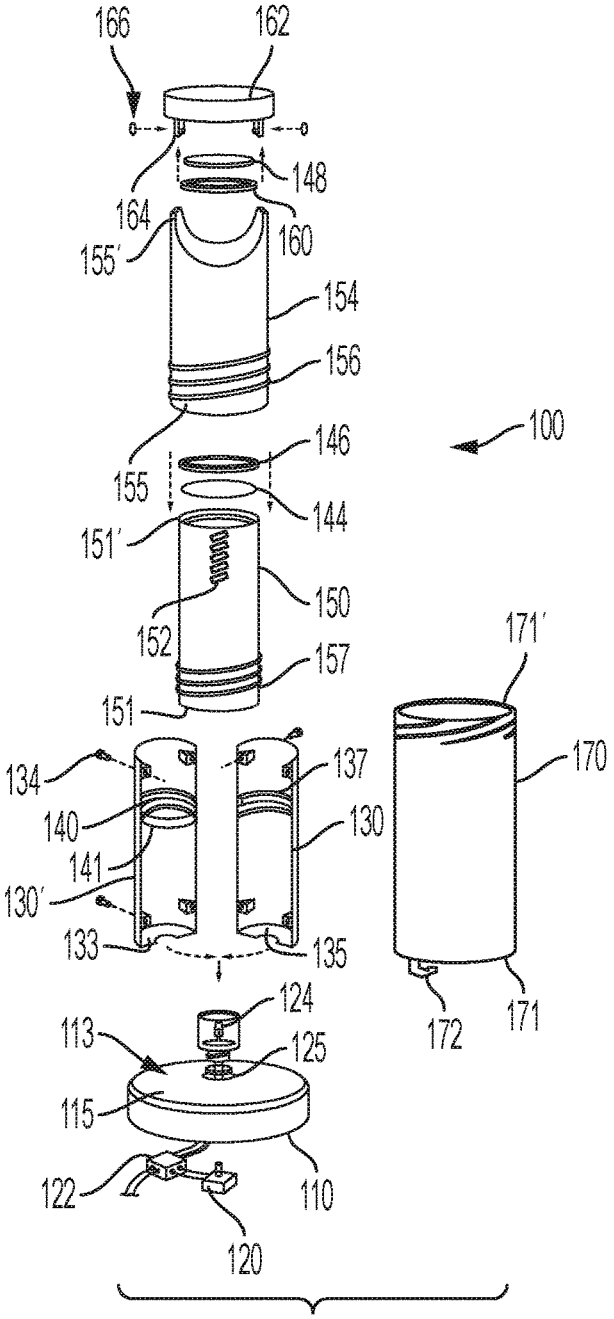
FIG. 1B is an exploded view of the lighting fixture of FIG. 1A.

FIG. 1B is an exploded view of the lighting fixture 100 of FIG. 1A. The base 110 can be a hollow lamp base which houses, for example, a potentiometer 120 and a laminating element driver 122 within a cavity. The base 110 can also be configured to include a battery or rechargeable battery, as desired. An aperture 125 can be provided through which an illuminating element 124 passes. The illuminating element 124 and can be an LED (light emitting diode) with a heat sink housing and an optic element.

Two or more apertures 113 can be provided on the upper surface 115 of the base 110 which engage the outer hollow member 170. A locking element 172, such as a hook, can be provided on the first outer hollow member end 171 and sized to fit within one of the two or more apertures 113 on the upper surface 115 of the base 110.

An optical lens housing member 130, which is a first optical lens housing member, can be provided which has two pieces and which is sized to fit within the outer hollow member 170. The optical lens housing member 130 has a lower surface 133 and an optical lens housing member aperture 135. When the two halves of the optical lens housing member 130 are positioned together, an optical lens housing member aperture 135 in the bottom surface allows the illuminating element 124 to pass through the optical lens housing member 130 when the optical lens housing member 130 sides are connected with, for example, hardware 134.

The outer hollow member 170 has a first outer hollow member end 171 and a second outer hollow member end 171'. The outer hollow member 170 can have a locking element 172 which secures the outer hollow member 170 to the base 110 via the apertures 113 on the base, as noted above.

One or more optical lenses 140, 141 engage a ledge 137 within the interior of the optical lens housing member 130. The one or more optical lenses 140, 141 can be positioned adjacent each other, as illustrated, or separated and can engage a single ledge or be positioned on separate ledges within the interior of the optical lens housing member. The one or more optical lenses 140, 141 can be positioned from about 4.25 inches to about 4.75 inches from an upper surface of the illuminating element 124. The one or more optical lenses 140, 141 fit within the optical lens housing member 130. A ring can be used to secure the lenses within the interior of the respective tubular members.

A second hollow member 150 is provided. A biconvex lens 144 is retained in place by a retainer 146. The second hollow member 150 is shown with the threads 157 near the second hollow member first end 151 and threads 152 near the second hollow member second end 151'.

A third hollow member 154, such as a threaded plastic tube, has threads 156 on an exterior surface. A mirror retaining ring is provided which retains a reflecting element 148, such as a mirrored glass. A retaining ring 160 is provided to secure the reflecting element 148 within a reflective enclosure 162. The reflective enclosure 162 has a plurality of hinge elements 164 which can pivotally engage the third hollow member 154 by the use of a securement member 166, such as a screw.

Figure 2A:
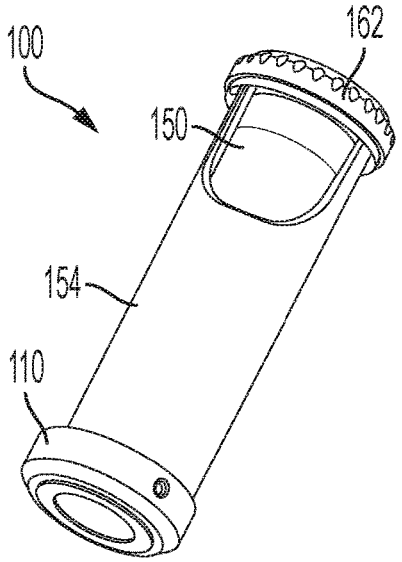
FIG. 2A is an exterior view of another suitable lighting fixture according to the disclosure.

FIG. 2A is an exterior view of another lighting fixture 100 according to the disclosure. The lighting fixture 100 has a base 110 and a third hollow member 154 engaging the base 110 at a third hollow member second end 155. A second hollow member 150, a second optical lens housing member, fits partially within the third hollow member 154. A reflective enclosure 162 engages the third hollow member 154 at the third hollow member second end 155'.

Figure 2B:
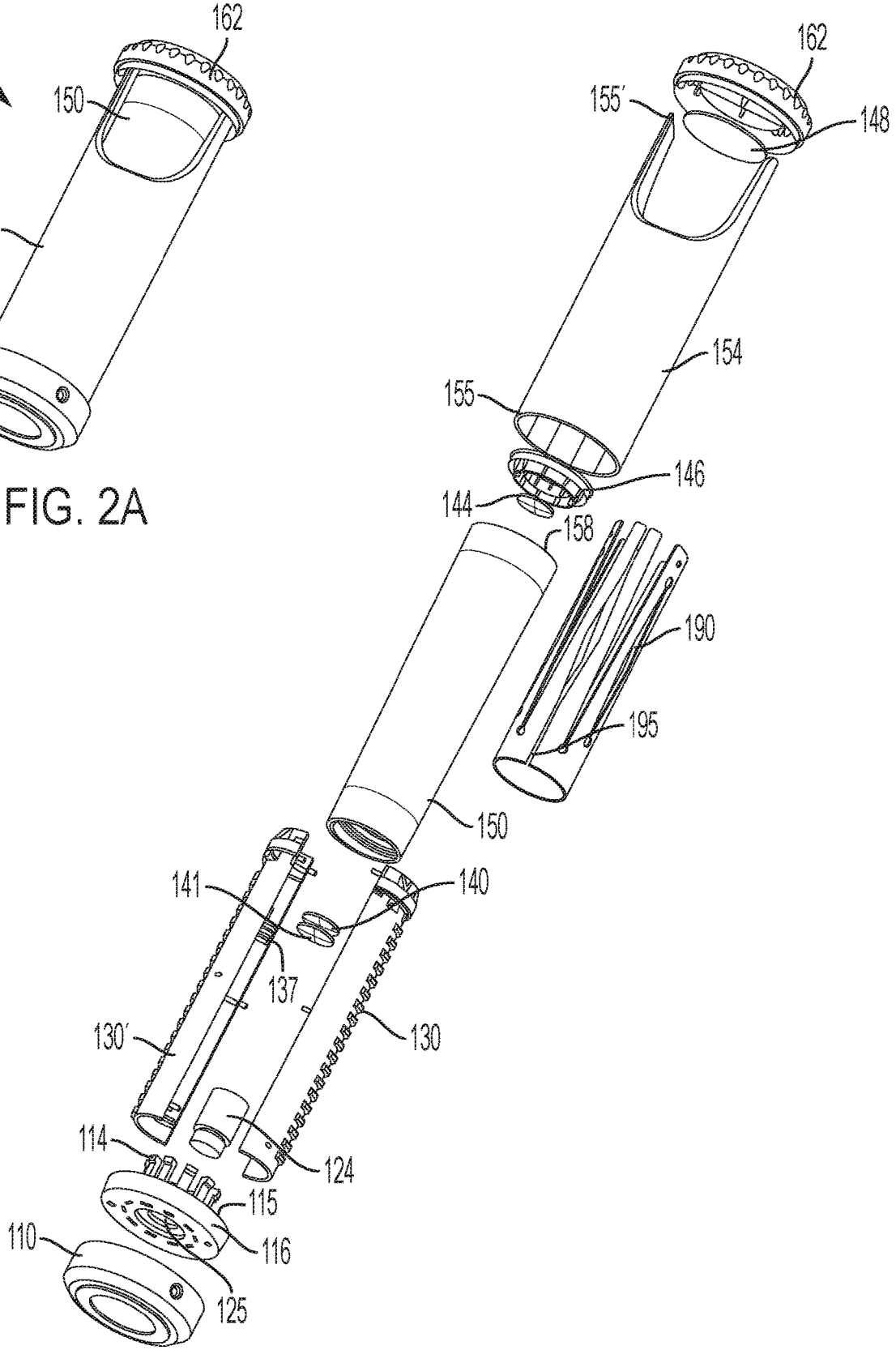
FIG. 2B is an exploded view of the lighting fixture of FIG. 2A.

FIG. 2B is an exploded view of the lighting fixture 100 of FIG. 2A. The base 110 can be a hollow lamp base which houses electronics for operating the lighting fixture 100 within a cavity. An aperture 125 can be provided in an upper surface 115 through which an illuminating element 124 passes. The illuminating element 124 can be an LED. The base 110 can have a base top 116 with an aperture 125 through the base top 116. The illuminating element 124 can pass through the aperture 125 to connect to electronics in the base 110. A plurality of anchors 114 are provided which extend from an upper surface 115 of the base top 116. The plurality of anchors 114 secure the base bottom 110 to the optical lens housing member 130. As will be appreciated by those skilled in the art, other mechanisms can be used to secure the base bottom 110 to the optical lens housing member 130 without departing from the scope of the disclosure.

The optical lens housing member 130 can have two pieces that fit together, as illustrated. One or more optical lenses 140, 141 are positioned on a ledge 137 or secured by a lens carrier within the interior of the optical lens housing member 130. The one or more optical lenses 140, 141 can be positioned adjacent each other, as illustrated, or separated. More than one ledge can be provided, if desired.

The reflective enclosure 162 can be a cap which includes a plurality of flexure tabs to hold the reflecting element 148. The reflective enclosure 162 can have a top surface and a side surface (for a round or oval configuration) or surfaces (for square, rectangular or triangular configurations). Within a recess of the cap, flexture tabs can be provided to secure the reflecting element 148. When the flexure tabs are pulled outward the reflecting element can be positioned within the cap and when the flexure tabs are released the reflecting element 148 is secured within the cap. The reflective enclosure 162 can have a width greater than the width of the reflecting element 148 with a gap between the flexture tabs holding the reflecting element 148 and the exterior of the reflective enclosure 162.

146A second hollow member 150 is provided. A biconvex lens 144 is positioned within an upper opening 158 of the second hollow member 150. The biconvex lens 144 is retained in place by a retainer 146. The retainer 146 can have a top surface with an aperture and a side surface (for a round or oval configuration) or surfaces (for square, rectangular or triangular configurations). Within a recess of the retainer 146, flexture tabs can be provided to secure the biconvex lens 144. When the flexure tabs are pulled outward the lens can be positioned within the retainer and when the flexure tabs are released the lens is secured within the retainer. The retainer 146 can have a width greater than the width of the biconvex lens 144 with a gap between the flexture tabs holding the biconvex lens 144 and the exterior of the retainer 146.

A third hollow member 154, such as a plastic tube. A reflective enclosure 162 is provided. Additionally, a flexible bearing member 190 is provided which fits around the second hollow member 150. The flexible bearing member 190 is hollow and has a plurality of elongated members which are positioned adjacent one another to create, for example, a flexibly shaped tubular member, as illustrated. The flexible bearing member 190 can have an elongated gap 191 along a length forming a complete gap along a length. The flexible bearing member 190 can further be formed from a plurality of connected elongated members 192 where a first elongated member is connected to an adjacent second elongated member at a first end and the second elongated member is connected to an adjacent third elongated member at a second end, different than the first end, with the "W" pattern repeated for the length of the flexible bearing member about the cross-sectional shape. A semicircular cut-out can be positioned within the bottom of the trough of each "W" as illustrated. The flexible bearing member 190 can be laser stamped from a polyethylene (PE) or low-density polyethylene (LDPE). The flexible bearing member 190 is configured to have a stiff section at a first end and a flexible section at a second end opposite the stiff section. The middle section of the flexible bearing member 190 can be made of thin sections that conform well to the interior of the second hollow member 150.

Figure 2C:
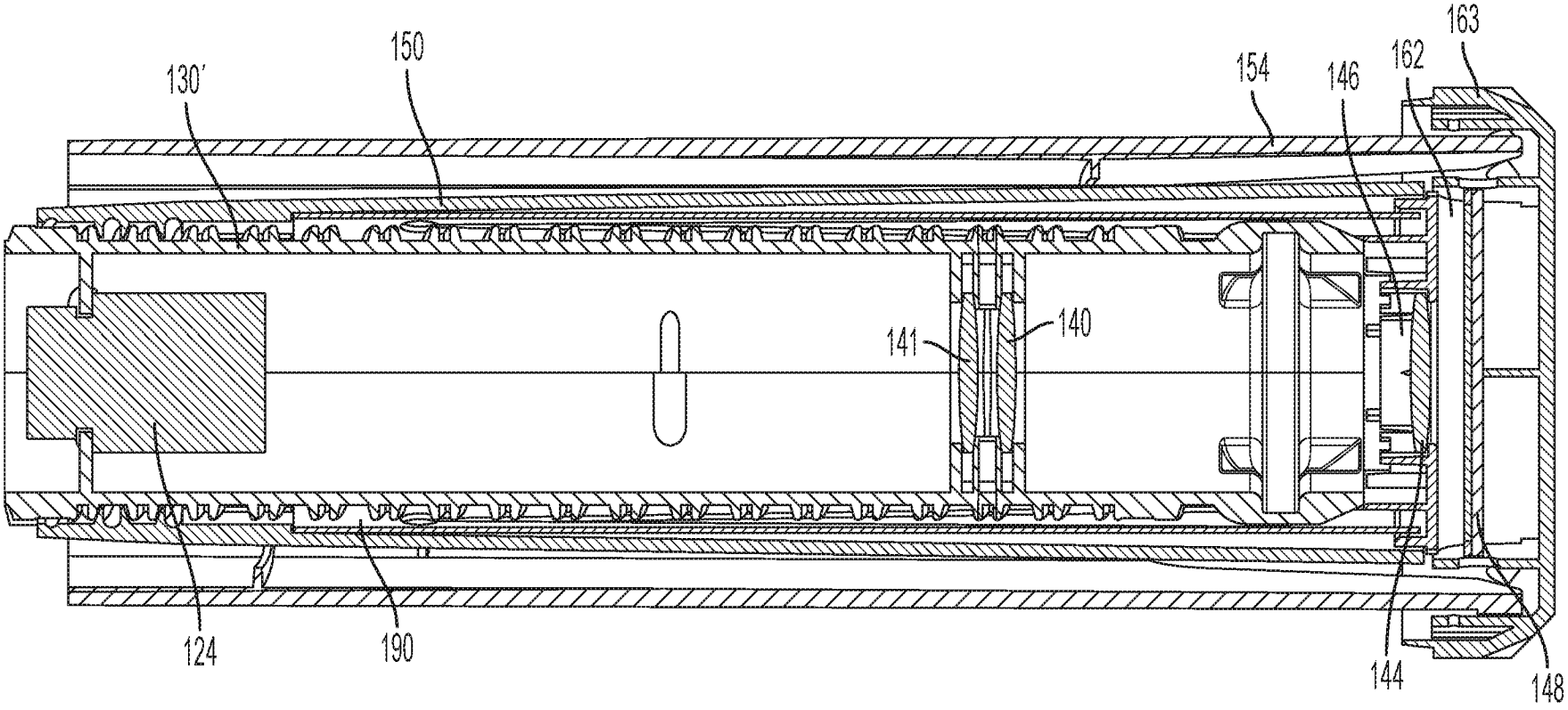
FIG. 2C is a cross-sectional view of the lighting fixture of FIG. 2A in a collapsed configuration.

FIG. 2C is a cross-sectional view of the lighting fixture 100 of FIG. 2A in the collapsed configuration without the base. The illuminating element 124 is a positioned at one end of the lighting device. A reflecting element 148 is positioned within a reflector housing 163 at an opposing end and held in place with a retainer such as reflective enclosure 162 on one side and a retainer 146 on the other side. A biconvex lens 144 is positioned below the reflecting element 148 and spaced apart from a pair of optical lenses 140, 141. The pair of optical lenses 140, 141 are secured within the two halves of the optical lens housing member 130, 130'. A flexible bearing member 190 is positioned around the optical lens housing member 130. From an exterior, a third hollow member 154 surrounds the second hollow member 150, which surrounds the flexible bearing member 190 which surrounds the optical lens housing member 130.

As will be appreciated by those skilled in the art, the lighting fixtures shown in FIGS. 1A-B and FIGS. 2A-B are depicted in a nestable tubular configuration having a round cross-section. Other configurations can be used without departing from the scope of the disclosure. For example, the orientation of the elements (one or more lenses, mirror and light source) can be vertical as illustrated or horizontal. The light source can be an LED, low-voltage incandescent bulb, fluorescent bulb, or any other suitable light source. A dimmer can also be provided in some configurations. A timer can also be included to control the amount of time the lighting device illuminates. Power sources such as an electrical cord with an electrical plug, battery, and solar cells. Each of the hollow members can also be configured to have a cross-sectional shape selected from, for example, oval, ovoid, square, rectangular, and triangular. The lighting device can also be configured to eliminate the need for expanding and collapsing the device, e.g., a single tube, or a dual tube configuration, with two or more lenses positioned within a central cavity.

Additionally, configurations can change which member fits within another member without departing from the scope of the disclosure. As will be appreciated by those skilled in the art, additional changes can be made based on the intended application of the light fixture in use, e.g., freestanding, tabletop, floor, and wall or surface mounted. The light fixtures are collapsible (manually or mechanically activated) or may have a fixed length. Other mechanisms for extension and retraction can be used, including, for example, spring-loaded mechanisms, electronically controlled mechanisms, pneumatic mechanism, and hydraulic mechanisms. Converting the fixture from a compressed configuration to an extended configuration can be achieved by the use of threaded tubular members and/or nested tubular members with sliding and locking mechanisms. The various hollow members can be retracted and/or extended by use of threaded tubes, nested tubes with sliding and locking mechanisms, and the like. The lenses can be enclosed or open. Enclosed lenses would reduce the overall amount of light in the room (which achieves the focused task lighting illustrated in FIGS. 5-6). Exposed lenses can also be used where focused task lighting is less critical.

The lenses fit within the lower inner tubular member and within the middle threaded tubular member. A ring can be used to secure the lenses within the interior of the respective tubular members.

Table 1 provides exemplar dimensions for select parts for the disclosed lighting devices. As will be appreciated by those skilled in the art, other size ranges can be used without departing from the scope of the disclosure.

TABLE 1

Exemplar Dimensions for Select Parts

| Part | Part # | Dimension | Size Range (inches) |
|---|---|---|---|
| Base | 110 | Length | 0.25-2.0 |
| Base | 110 | Diameter | 2.5-4.0 |
| Optical Lens Housing Member | 130 | Length | 5.5-7.5 |
| Optical Lens Housing Member | 130 | Diameter | 2.0-2.5 |
| Second Hollow Member | 150 | Length | 5.5-7.5 |
| Second Hollow Member | 150 | Diameter | 2.0-2.5 |
| Third Hollow Member | 154 | Length | 6.5-8.5 |
| Third Hollow Member | 154 | Diameter | 2.125-2.5 |
| Reflective Enclosure | 162 | Length | 0.25-2.0 |
| Reflective Enclosure | 162 | Diameter | 2.5-4.0 |
| Flexible Bearing Member | 190 | Length | 5.5-7.5 |
| Flexible Bearing Member | 190 | Diameter | 2.0-2.5 |
| Optical lens | 140<br>141<br>144 | Thickness | 0.2-0.3 |

The lighting fixture 100 and components can be made from a variety of materials including, but not limited to: metal, plastic, glass, carbon fiber, paper, cardboard or fabric.

Table 2 provides exemplar dimensions between select parts for the disclosed lighting devices when the lighting device is in an expanded configuration. As will be appreciated by those skilled in the art, other size ranges can be used without departing from the scope of the disclosure.

TABLE 2

Exemplar Dimensions for Deployed Lighting Device

| Parts | Size Range (inches) |
|---|---|
| Distance between the Illuminating element 124 to reflecting element 148 | 18-22 |
| Distance between the Biconvex lens 144 to reflecting element 148 | 6-9 |
| Distance between the One or more Optical lenses 140, 141 to biconvex lens 144 | 6-10 |

TABLE 2-continued

Exemplar Dimensions for Deployed Lighting Device

| Parts | Size Range (inches) |
|---|---|
| Distance between the one or more optical lenses 140, 141 | 0.25-1.0 |

Figure 3A:
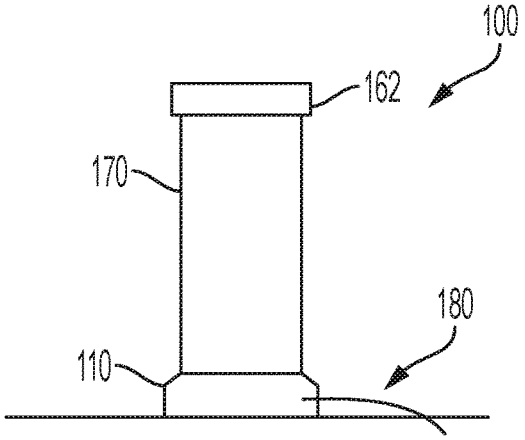
FIG. 3A is an exterior view of a lighting fixture in a collapsed configuration.

FIG. 3A is an exterior view of a lighting fixture 100 such as the one illustrated in FIGS. 1A-B, in a collapsed configuration. In the collapsed configuration, the outer hollow member 170 is visible, along with the base 110 and the reflective enclosure 162. A power cord 180 can be provided when the power source is an electrical wall socket. Other power sources can be used without departing from the scope of the disclosure including, but not limited to, battery and solar. In the collapsed configuration, the height of the lighting fixture 100 is from about 8.0 inches to about 11.5 inches. When fully extended, the lighting FIG. 100 has a height of from about 20.75 inches to about 25.0 inches. As will be appreciated by those skilled in the art, the configuration of FIG. 2A has a similar configuration in the collapsed configuration.

Figure 3B:
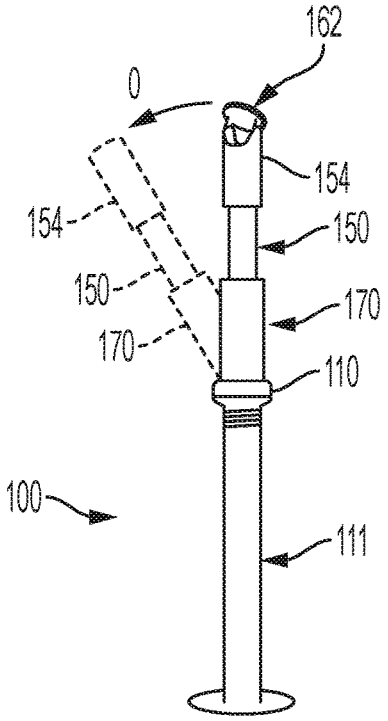
FIG. 3B is an exterior view in an expanded configuration of a floor lamp with a floor lamp base.

FIG. 3B is an exterior view of a lighting fixture 100 such as the one illustrated in FIGS. 1A-B, in an expanded configuration positioned on a base extension 111. The lighting fixture 100 can rotate off a longitudinal axis through the base extension 111 by an angle $\Theta$. The base extension 111 has a height of from about 24.0 inches to about 48.0 inches and a diameter of from about 3.5 inches to about 6.0 inches. When the lamp is fully extended and positioned on the base extension, the height is from about 44.75 inches to about 73.0 inches. The base extension 111 can be configured to securely engage the lighting fixture 100. Any suitable securement can be used without departing from the scope of the disclosure. For example, the lighting fixture 100 and base extension 111 can be secured by a threaded arrangement, or a snap fit, or mechanical (e.g., nuts and bolts), or magnetic, or plastic slide and lock tabs. As will be appreciated by those skilled in the art, the lighting fixture 100 of FIG. 2A can also be configured to rotate off a longitudinal axis through a base extension.

Figure 4A:
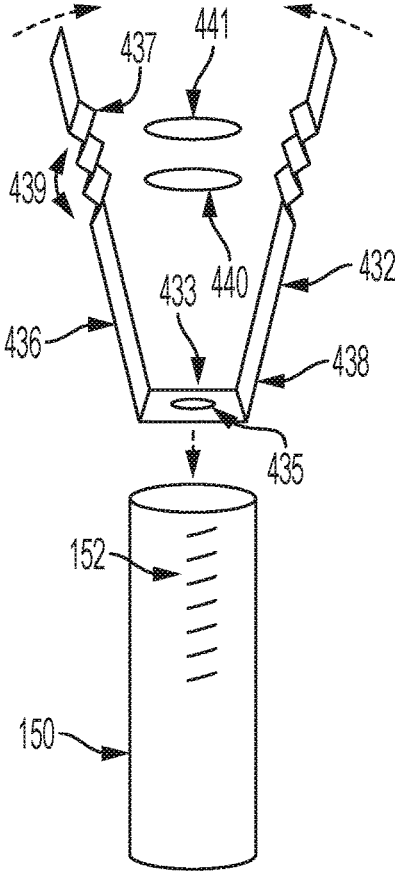
FIG. 4A is an alternative configuration of the optical lens housing member of FIG. 1B.

FIG. 4A is an alternative configuration and method of the optical lens housing member of FIG. 1B. The second hollow member 150 has an inner member 432 with an optical lens housing member aperture 435. The inner member 432 has two parallel walls 436, 438 which are perpendicular to a lower surface 433. Each of the two parallel walls 436, 438, has folds 439 which provide a ledge 437 on which the optical lenses 440, 441 rest when positioned within the second hollow member 150.

Figure 4B:
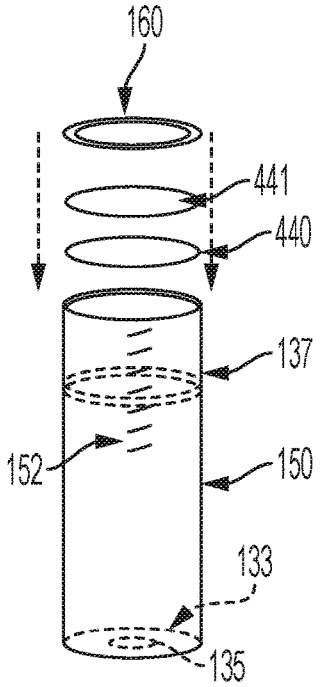
FIG. 4B is an alternative method for inserting two biconvex lenses within the optical housing member of FIG. 1B.

FIG. 4B is an alternative method for placing two biconvex lenses within the of the optical lens housing member of FIG. 1B. The second hollow member 150 is shown with the threading protrusions 152. A ledge 137 is provided on an interior surface of the second hollow member 150 upon which the optical lenses 440, 441 rest. A retaining ring 160 is provided to secure the optical lenses 440, 441 within the second hollow member 150.

Figure 5:
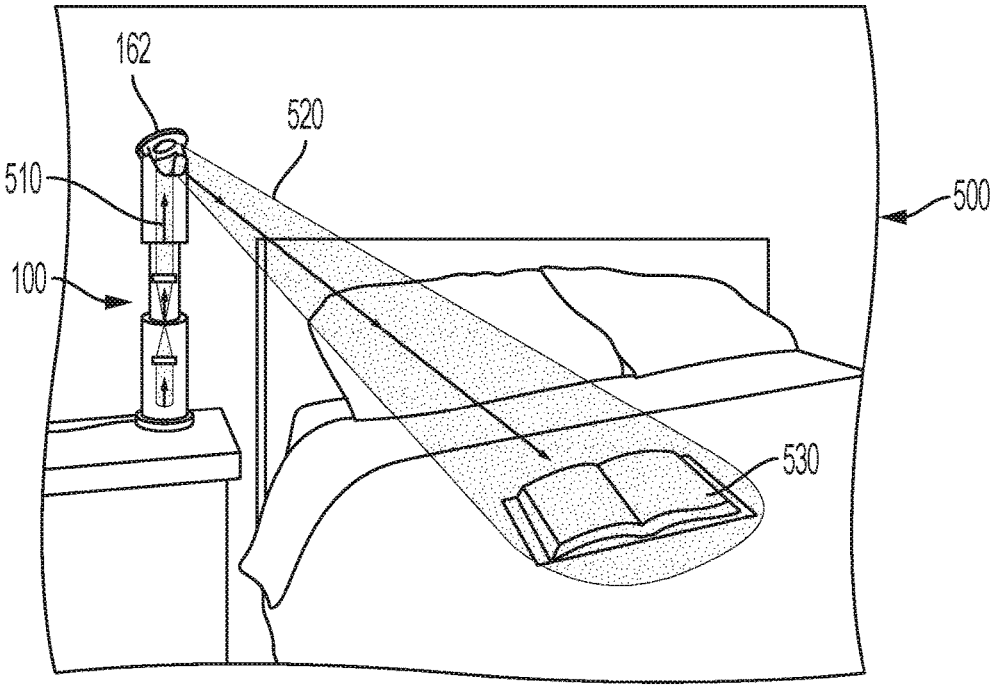
FIG. 5 illustrates an example of a lighting fixture of the disclosure in use for the task of reading in an otherwise dark environment.

FIG. 5 illustrates an environment 500 where a lighting fixture 100 of the disclosure is in use for the task of reading in an otherwise dark environment. The lighting fixture 100 is in an extended configuration and the reflective enclosure 162 is angled to direct light 510 that is transmitted from the illuminating element in the base of the fixture upward through the interior of the lighting fixture 100 and passing through the plurality of lenses, and then reflecting off of the reflecting element 148 in the reflective enclosure 162 to direct the light beam 520 toward the target, a book 530 on a bed 540.

Figure 6:
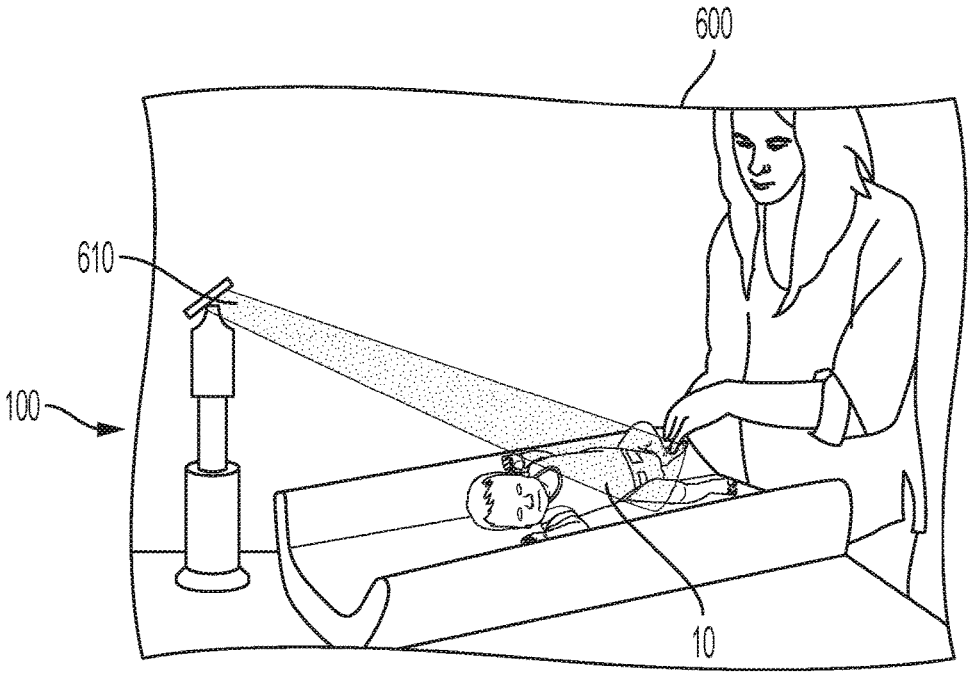
FIG. 6 illustrates an example of a lighting fixture of the disclosure in use for the task of changing a diaper in an otherwise dark environment.

FIG. 6 illustrates another example of a lighting fixture of the disclosure in use in an environment 600 for the task of changing a diaper in an otherwise dark environment. The lighting fixture 100 direct the light through the interior of the lighting fixture and reflects the light 610 onto a baby 10 on a changing table at a location where the mother can see the diaper and without illuminating the mother's face or the baby's face.

As will be appreciated by those skilled in the art, the environment illustrated in FIGS. 5 and 6, could also be a target area for illumination such as a piece of artwork or a sculpture. Other applications for the lighting devices would be apparent without departing from the scope of the disclosure. Additionally, as noted above, configurations of the lighting devices can use a one or two tubular member with two or more lenses and a reflecting element to achieve a similar result without departing from the scope of the disclosure.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A lighting device comprising:

a base; a light element positioned on an upper surface of the base wherein the light element emits light;

a first hollow member having a first hollow member first end, a first hollow member second end and a cavity within the first hollow member wherein the first hollow member first end engages the upper surface of the base;

a pair of biconvex lenses positioned within the cavity of the first hollow member;

a third biconvex lens;

a reflector opposite the base wherein the reflector reflects light from the cavity of the first hollow member to a location exterior to the first hollow member; and a power source.

2. The lighting device of claim 1 wherein the light source is an LED light.

3. The lighting device of claim 1 wherein the light source passes through an aperture in a base top.

4. The lighting device of claim 1 wherein the light source passes through an aperture in the first hollow member.

5. The lighting device of claim 1 wherein the cross-sectional shape of the lighting device is selected from the group comprising round, oval, ovoid, square, rectangular and triangular.

6. The lighting device of claim 1 wherein the pair of biconvex lenses are positioned adjacent each other within the first hollow member.

7. The lighting device of claim 1 wherein the third biconvex lens is positioned adjacent the reflector positioned at the first hollow member second end.

8. The lighting device of claim 1 further comprising a cap for housing the reflector.

9. The lighting device of claim 1 wherein the reflector is rotatable.

10. The lighting device of claim 1 further comprising a second hollow member and a third hollow member, wherein the third hollow member is positionable about the second hollow member.

11. The lighting device of claim 1 further comprising one or more of a dimmer and a timer.

12. The lighting device of claim 1 further comprising a base extension.

13. The lighting device of claim 1 wherein the power source is selected from an electrical cord with an electrical plug, one or more batteries, and one or more solar cells.

14. A method of illuminating a target comprising:

providing a lighting device wherein the lighting device comprises a base, a light element positioned on an upper surface of the base wherein the light element emits light, a first hollow member having a first hollow member first end, a first hollow member second end and a cavity within the first hollow member wherein the first hollow member first end engages the upper surface of the base, a pair of biconvex lenses positioned within a cavity of the first hollow member, a third biconvex lens, a reflector opposite the base wherein the reflector reflects light from the cavity of the first hollow member to a location exterior to the first hollow member, and a power source; and providing a discrete light to a target location.

15. The method of illuminating a target of claim 14 further comprising: changing the lighting device from a compressed configuration to an expanded configuration.

16. The method of illuminating a target of claim 15 further comprising: adjusting an amount of expansion of the lighting device to change an amount of light focused on the target location.

17. The method of illuminating a target of claim 14 further comprising: activating a dimmer to alter an amount of light generated by the lighting device.

18. The method of illuminating a target of claim 14 further comprising: securing the lighting device to a base extension.

19. A lighting device comprising:

a base;

a light element means positioned on an upper surface of the base wherein the light element means emits light;

a first hollow member means having a first hollow member first end, a first hollow member second end and a cavity within the first hollow member means wherein the first hollow member first end engages the upper surface of the base;

a pair of biconvex lenses positioned within the cavity of the first hollow member means;

a third biconvex lens;

a reflector means opposite the base wherein the reflector reflects to light from the cavity of the first hollow member to a location exterior to the first hollow member; and a power source.

20. The lighting device of claim 19 wherein the cross-sectional shape of the lighting device is selected from the group comprising round, oval, ovoid, square, rectangular and triangular.

21. The lighting device of claim 19 wherein the pair of biconvex lenses are positioned adjacent each other within the first hollow member means.

22. The lighting device of claim 19 wherein the third biconvex lens is positioned adjacent the reflector means positioned at the first hollow member second end.

23. The lighting device of claim 19 further comprising a second hollow member means and a third hollow member means positionable about the second hollow member means.

* * * * *